US007716052B2

(12) United States Patent
Aaron et al.

(10) Patent No.: US 7,716,052 B2
(45) Date of Patent: May 11, 2010

(54) METHOD, APPARATUS AND COMPUTER PROGRAM PROVIDING A MULTI-SPEAKER DATABASE FOR CONCATENATIVE TEXT-TO-SPEECH SYNTHESIS

(75) Inventors: Andrew S. Aaron, Ardsley, NY (US); Ellen M. Eide, Tarrytown, NY (US); Wael M. Hamza, Yorktown Heights, NY (US); Michael A. Picheny, White Plains, NY (US); Charles T. Rutherfoord, Delray Beach, FL (US); Zhi Wei Shuang, Beijing (CN); Maria E. Smith, Davie, FL (US)

(73) Assignee: Nuance Communications, Inc., Burlington, MA (US)

( * ) Notice: Subject to any disclaimer, the term of this patent is extended or adjusted under 35 U.S.C. 154(b) by 769 days.

(21) Appl. No.: 11/101,223

(22) Filed: Apr. 7, 2005

(65) Prior Publication Data

US 2006/0229876 A1 Oct. 12, 2006

(51) Int. Cl.
*G10L 13/00* (2006.01)
*G10L 13/08* (2006.01)
*G10L 13/06* (2006.01)

(52) U.S. Cl. ..... 704/258; 704/267; 704/268; 704/269

(58) Field of Classification Search ..... 704/258–269
See application file for complete search history.

(56) References Cited

U.S. PATENT DOCUMENTS 5,327,521 A * 7/1994 Savic et al. ..... 704/272
5,737,725 A * 4/1998 Case ..... 704/260
5,860,064 A 1/1999 Henton ..... 704/260
5,878,393 A 3/1999 Hata et al. ..... 704/260
6,148,285 A * 11/2000 Busardo ..... 704/260
6,151,575 A * 11/2000 Newman et al. ..... 704/260
6,336,092 B1 * 1/2002 Gibson et al. ..... 704/268
6,366,883 B1 * 4/2002 Campbell et al. ..... 704/260
6,442,519 B1 * 8/2002 Kanevsky et al. ..... 704/243
6,725,199 B2 4/2004 Brittan et al. ..... 704/258

(Continued)

OTHER PUBLICATIONS

A. J. Hunt and A. W. Black, "Unit selection in a concatenative speech synthesis system using a large speech database," Proc. 1996 IEEE ICASSP, pp. 373-376.*

(Continued)

*Primary Examiner*—Richemond Dorvil
*Assistant Examiner*—Jialong He
(74) *Attorney, Agent, or Firm*—Wolf, Greenfield & Sacks, P.C.

(57) ABSTRACT

A method, apparatus and a computer program product to generate an audible speech word that corresponds to text. The method includes providing a text word and, in response to the text word, processing pre-recorded speech segments that are derived from a plurality of speakers to selectively concatenate together speech segments based on at least one cost function to form audio data for generating an audible speech word that corresponds to the text word. A data structure is also provided for use in a concatenative text-to-speech system that includes a plurality of speech segments derived from a plurality of speakers, where each speech segment includes an associated attribute vector each of which is comprised of at least one attribute vector element that identifies the speaker from which the speech segment was derived.

17 Claims, 3 Drawing Sheets

U.S. PATENT DOCUMENTS

| | | | | |
|---|---|---|---|---|
| 6,792,407 | B2 * | 9/2004 | Kibre et al. | 704/260 |
| 7,249,021 | B2 * | 7/2007 | Morio et al. | 704/258 |
| 2001/0056347 | A1 * | 12/2001 | Chazan et al. | 704/258 |
| 2002/0103648 | A1 * | 8/2002 | Case et al. | 704/260 |
| 2002/0120450 | A1 * | 8/2002 | Junqua et al. | 704/258 |
| 2002/0133348 | A1 * | 9/2002 | Pearson et al. | 704/258 |
| 2002/0143542 | A1 * | 10/2002 | Eide | 704/260 |
| 2002/0193996 | A1 * | 12/2002 | Squibbs et al. | 704/260 |
| 2003/0182120 | A1 * | 9/2003 | Hwang | 704/251 |
| 2005/0256716 | A1 * | 11/2005 | Bangalore et al. | 704/260 |
| 2006/0041429 | A1 * | 2/2006 | Amato et al. | 704/260 |

OTHER PUBLICATIONS

Tamura, Masatsune / Masuko, Takashi / Tokuda, Keiichi / Kobayashi, Takao (2001): "Text-to-speech synthesis with arbitrary speaker's voice from average voice", In EUROSPEECH-2001, 345-348.*

X. Huang and K.-F. Lee, "On speaker-independent, speaker-dependent and speaker-adaptive speech recognition," IEEE Trans. Speech Audio Processing, vol. 1, pp. 150-157, Apr. 1993.*

Kubala, F., Schwartz, R., and Barry, C. Speaker Adaptation Using Multiple Reference Speakers. in: DARPA Speech and Language Workshop. Morgan Kaufmann Publishers, San Mateo, CA, 1989.*

X. Huang, "A study on speaker-adaptive speech recognition," in DARPA Speech and Language Workshop. San Mateo, CA Morgan Kaufmann Publishers, 1991.*

Montero, Juan Manuel / Gutierrez-Arriola, Juana M. / Palazuelos, Sira / Enriquez, Emilia / Aguilera, Santiago / Pardo, José Manuel (1998): "Emotional speech synthesis: from speech database to TTS", In ICSLP-1998, paper 1037.*

J. Yamagishi, K. Onishi, T. Masuko, and T. Kobayashi, "Acoustic modeling of speaking styles and emotional expressions in HMM-based speech synthesis," IEICE Trans. Inf. & Syst., vol. E88-D, No. 3, pp. 502-509, Mar. 2005.*

"Speech Synthesis Markup Language (SSML) Version 1.0", Internet (http://www.w3.org/TR/2004/REC-speech-synthesis-20040907/), Mar. 28, 2005, pp. 1-48.

Eide, E. et al., "A Corpus-Based Approach To <AHEM/> Expressive Speech Synthesis", Proceedings of the 5th ISCA Speech Synthesis Workshop, Pittsburgh, PA, Jun. 14-16, 2004.

Hamza, W. et al., "The IBM Expressive Speech Synthesis System", Proceedings ICSLP, 2004, Jeju Island, Korea.

Plumpe, M. et al., paper entitled "Which is More Important in a Concatenative Text To Speech System—Pitch, Duration, or Spectral Discontinuity?", Microsoft Research.

Morais, E. S. et al., paper entitled "Concatenative Text-To-Speech Synthesis Based on Prototype Waveform Interpolation (A Time Frequency Approach)".

Paper entitled "IBM Concatenative Text-To-Speech: The Next Generation of Speech Synthesis Arrives", Oct. 25, 2001, pp. 1-8.

Plumpe, M. et al., paper entitled "Which is More Important in a Concatenative Text To Speech System—Pitch, Duration, or Spectral Discontinuity?", Microsoft Research, Publish Year: 1998.

Morais, E. S. et al., paper entitled "Concatenative Text-To-Speech Synthesis Based on Prototype Waveform Interpolation (A Time Frequency Approach)", Publish Year: 2000.

* cited by examiner

| | SPEAKER 1 | SPEAKER 2 | SPEAKER 3 |
|---|---|---|---|
| SPEAKER 1 | 0 | 0.2 | 0.5 |
| SPEAKER 2 | 0.1 | 0 | 0.5 |
| SPEAKER 3 | 0.3 | 0.3 | 0 |

COST MATRIX

METHOD, APPARATUS AND COMPUTER PROGRAM PROVIDING A MULTI-SPEAKER DATABASE FOR CONCATENATIVE TEXT-TO-SPEECH SYNTHESIS

TECHNICAL FIELD

These teachings relate generally to text-to-speech (TTS) systems and methods and, more particularly, relate to concatenative TTS (CTTS) systems and methods.

BACKGROUND

Conventional CTTS systems use a database of speech segments (e.g., phonemes, syllables, and/or entire words) recorded from a single speaker to select speech segments to concatenate based on some input text string. In order to achieve high-quality synthetic speech, however, a large amount of data need be collected from the single speaker; thus making the development of such a database time-consuming and costly.

Reference with regard to some conventional approaches may be had, for example, to U.S. Pat. No. 6,725,199 B2, "Speech Synthesis Apparatus and Selection Method", Brittan et al.; U.S. Pat. No. 5,878,393, "High Quality Concatenative Reading System", Hata et al.; and U.S. Pat. No. 5,860,064, "Method and Apparatus for Automatic Generation of Vocal Emotion in a Synthetic Text-to-Speech System", Caroline G. Henton. For example, the system described in U.S. Pat. No. 5,878,393 employs a dictionary of sampled sounds, where the dictionary may include separate dictionaries of sounds sampled at different sampling rates. The dictionary may also store all pronunciation variants of a word for each of a plurality of prosodic environments.

New domains for deploying text-to-speech invariably arise, usually accompanied by a desire to supplement the database of recordings used to build a CTTS system with additional data corresponding to words, phrases and/or sentences which are highly relevant to the new domain, such as specific company names or technical phrases not present in the original script.

However, in the event that the original speaker whose voice was recorded and sampled to populate the dictionary is no longer available to make an additional recording, a new speaker may be required to re-record all of the original script, in addition to the new domain-specific script. Such a process would not be efficient for a number of reasons.

SUMMARY OF THE PREFERRED EMBODIMENTS

The foregoing and other problems are overcome, and other advantages are realized, in accordance with the presently preferred embodiments of these teachings.

In one aspect thereof this invention provides a method and an apparatus to generate an audible speech word that corresponds to text. The method includes providing a text word and, in response to the text word, processing pre-recorded speech segments that are derived from a plurality of speakers to selectively concatenate together speech segments based on at least one cost function to form audio data for generating an audible speech word that corresponds to the text word.

In another aspect thereof this invention provides a data structure embodied with a computer readable medium for use in a concatenative text-to-speech system. The data structure includes a plurality of speech segments that are derived from a plurality of speakers, where each speech segment includes an associated attribute vector each of which is comprised of at least one attribute vector element that identifies the speaker from which the speech segment was derived.

In preferred embodiments of this invention the speech segments are pre-recorded by a process that comprises designating one speaker as a target speaker, examining an input speech segment to determine if it is similar to a corresponding speech segment of the target speaker and, if it is not, modifying at least one characteristic of the input speech segment, such as a temporal and/or a spectral characteristic, so as to make it more similar to the corresponding speech segment of the target speaker. The preferred embodiments of this invention also enable the pooling of speech segments of the target speaker and the possibly modified auxiliary speakers to form a larger database from which to draw speech segments for concatenative text-to-speech synthesis.

BRIEF DESCRIPTION OF THE DRAWINGS

The foregoing and other aspects of these teachings are made more evident in the following Detailed Description of the Preferred Embodiments, when read in conjunction with the attached Drawing Figures, wherein.

DETAILED DESCRIPTION OF THE PREFERRED EMBODIMENTS

In accordance with exemplary embodiments of this invention a system and method operate to combine speech segment databases from several speakers to form a larger combined database from which to select speech segments at run-time.

Figure 1:
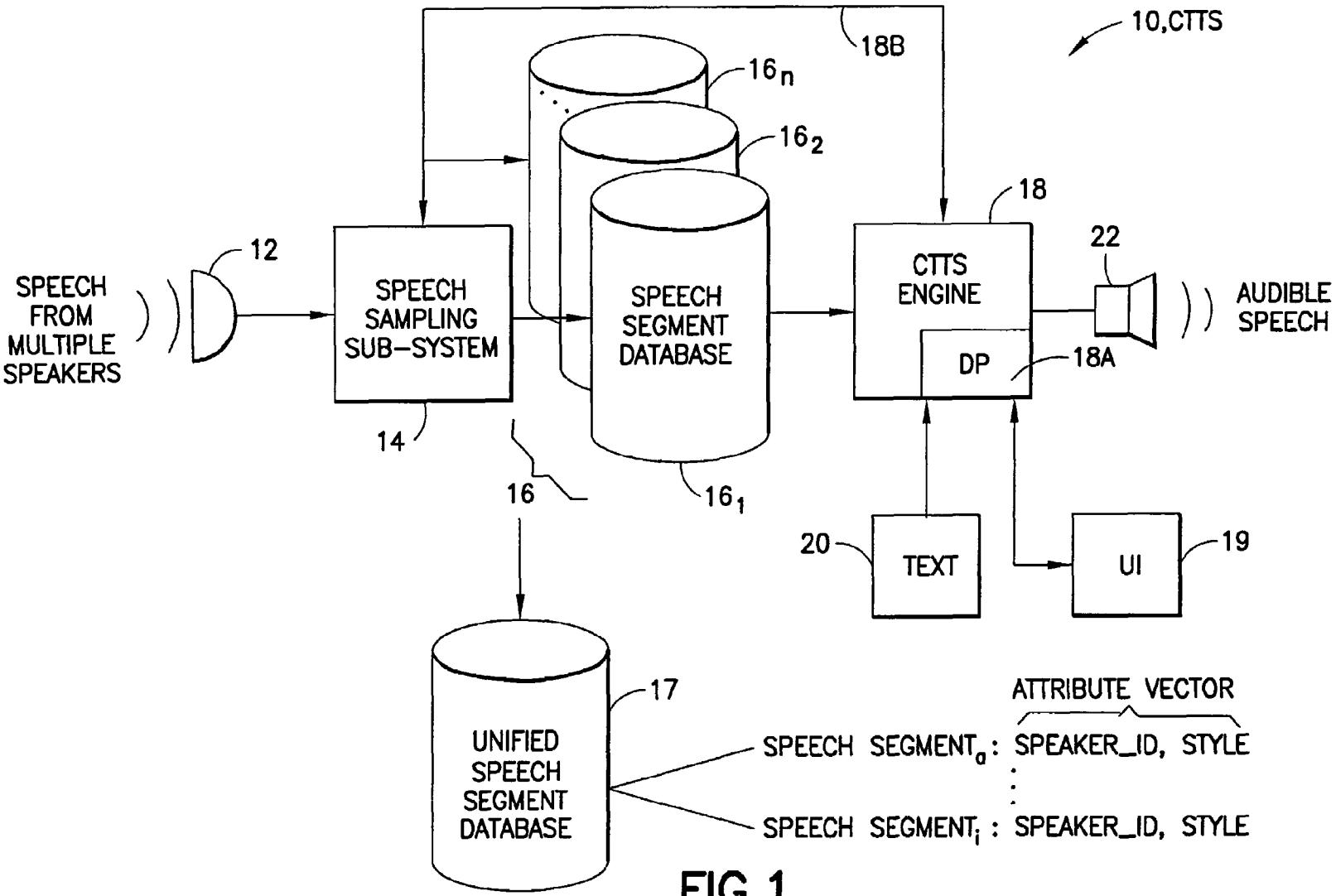
FIG. 1 is a block diagram of a CTTS system in accordance with embodiments of this invention.

Referring to FIG. 1, an exemplary CTTS system 10 in accordance with examples of this invention includes a speech transducer, such as a microphone 12, having an output coupled to a speech sampling sub-system 14. The speech sampling sub-system 14 may operate at one or at a plurality of sampling rates, such as 11 kHz, 22 kHz and/or 44.1 kHz. The output of the speech sampling sub-system 14 is stored in a memory database 16 for use by a CTTS engine 18 when converting input text 20 to audible speech that is output from a loudspeaker 22 or some other suitable output speech transducer. The database 16 may contain data representing phonemes, syllables, or other component parts of uttered speech, or it may contain, less preferably, entire words. The CTTS engine 18 is assumed to include at least one data processor (DP) 18A that operates under control of a stored program to execute the functions and methods in accordance with embodiments of this invention. The CTTS system 10 may be embodied in, as non-limiting examples, a desk top computer, a portable computer, a work station, a main frame computer, or it may be embodied on a card or module and embedded within another system. The CTTS engine 18 may be implemented in whole or in part as an application program executed by the DP 18A.

In accordance with exemplary embodiments of this invention the database 16 may actually be viewed as a plurality of separate databases $\mathbf{16}_1$, $\mathbf{16}_2$, . . . , $\mathbf{16}_n$ each storing sampled speech segments recorded from one of a plurality of speakers, for example two, three or more speakers who read the same or different text words, phrases and/or sentences. Assuming by way of example, and not as a limitation, that the sampled speech segments of an original speaker are stored in the database $16_1$, then additional speech segment data stored in the databases $16_2$-$16_n$ may be derived from one or more auxiliary speakers who naturally sound similar (that is, have similar spectral characteristics and pitch contours) to some original speaker, or the additional speech segment data may be derived from one or more auxiliary speakers who sound dissimilar to the original speaker, but whose pitch and/or spectral characteristics are modified by speech sampling subsystem 14 using suitable signal processing so that the resulting speech sounds similar to the original speaker. For those speakers who are processed to sound like the original speaker, the processed speech database 16 may be combined with the other databases to form a single database, while for speakers who naturally sound like the original speaker their unprocessed speech segment data may be combined with the data from the other speakers. After combining data from two or more speakers, it is preferred that one large (unified) database 17 is formed, which allows for higher quality speech output.

It is thus preferred to employ one or more signal processing techniques to transform the input speech from two or more speakers in order to pool data from the several speakers to sound as if it all originated from the same speaker. Either manual hand-tuning or automatic methods of finding the appropriate transformation may be used for this purpose of populating the unified speech segment database 17.

The CTTS 10 may then be built from a combination of the optionally processed supplemental databases $16_2, \ldots, 16_n$ and the original database $16_1$ for the purpose of enhancing the quality of the output speech. Note that the original, typically preferred speaker need not be present when recording and storing the speech annunciated by the other (auxiliary) speakers.

The foregoing process may be of particular value when updating a legacy CTTS system to include new words, phrases and/or sentences which are highly relevant to a new domain or context for the CTTS system. In this case the legacy speaker is naturally the "target" speaker, and the other speaker or speakers from whom the additional data come are naturally the "auxiliary" speakers. However, it should be appreciated that in other embodiments the CTTS system 10 may be designed from the start to include the multiple speech segment databases $16_1, 16_2, \ldots, 16_n$ and/or the unified speech segment database 17. In this latter case it may still be the case that one of the speakers is a target speaker, or one having a most preferred speech sound for a given application of the CTTS system 10, to which the other speakers are compared and their speech modified as necessary to more closely resemble the speech of the target speaker.

Figures 2, 3:
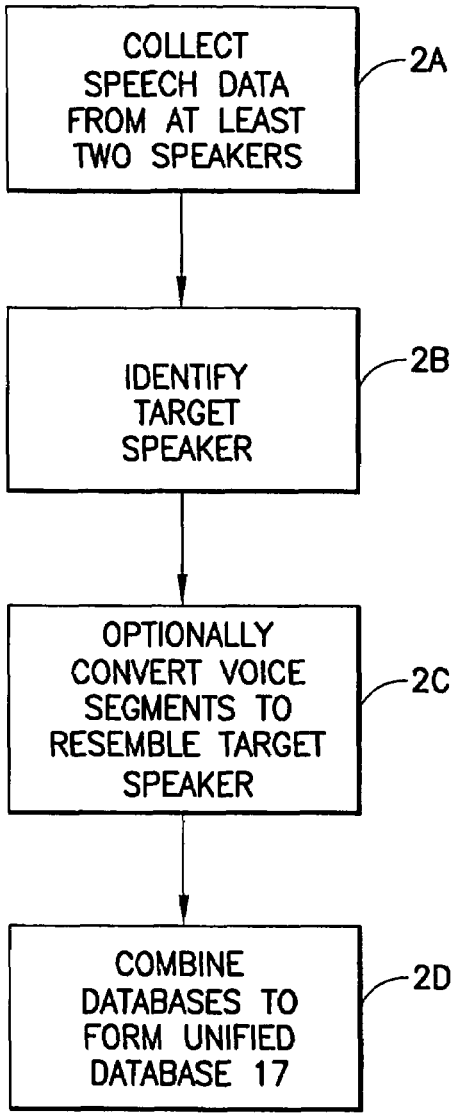
FIG. 2 is a logic flow diagram that depicts a method in accordance with the embodiments of this invention.
FIG. 3 illustrates an exemplary cost matrix for a "speaker" element of an attribute vector.
Figure 4:
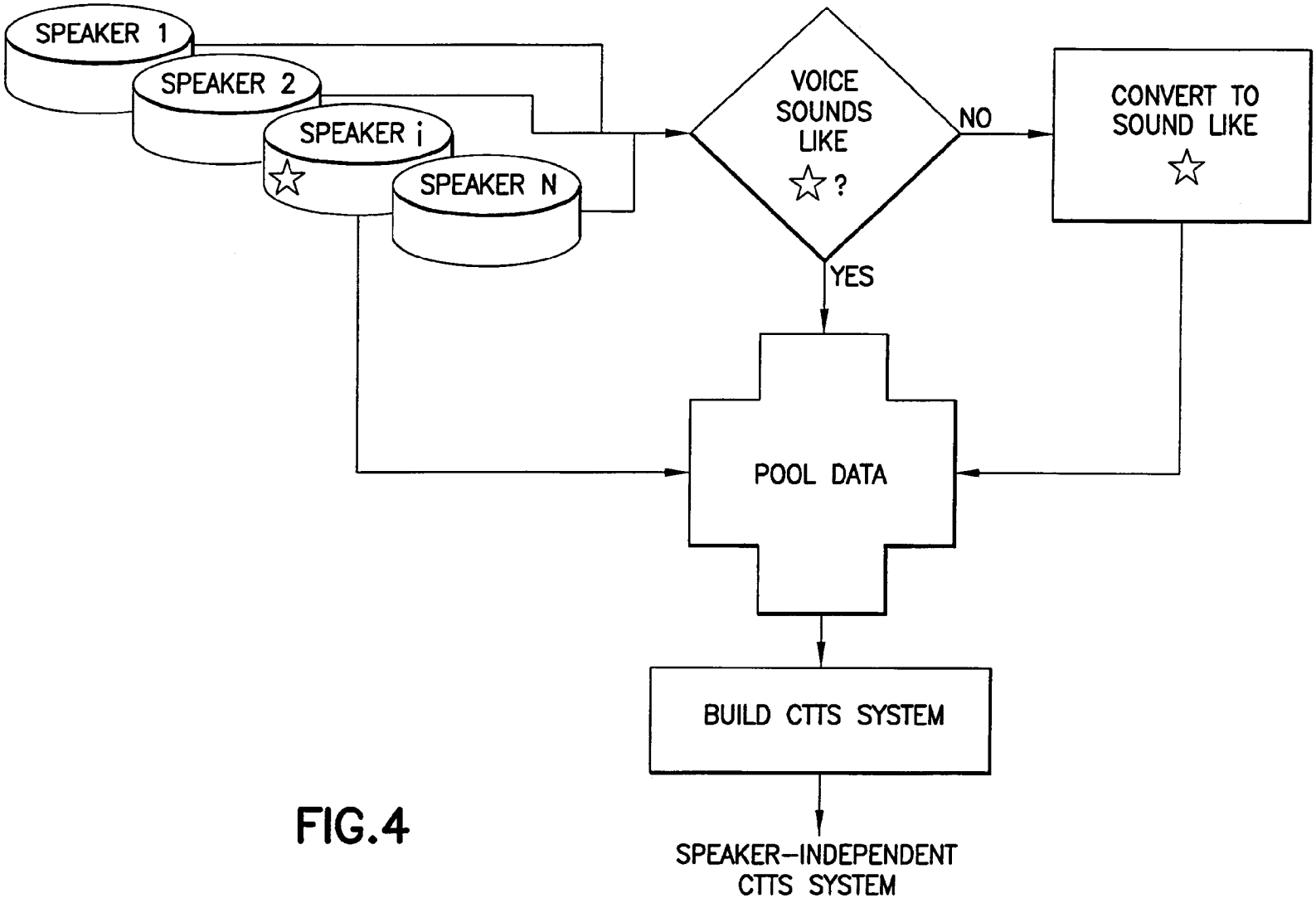
FIG. 4 is another view of the method shown in FIG. 2.

Referring to FIG. 2 and to FIG. 4, a method in accordance with embodiments of this invention performs the following operations. At Block 2A the CTTS 10 collects speech data from at least two speakers. At Block 2B the CTTS engine 18, possibly in cooperation with a user of the CTTS 10 via some suitable user interface (UI) 19, identifies a voice as being that of the "target speaker", shown designated with a star in FIG. 4. Preferably the CTTS 10 uses the voice of one of the speakers for whom a database 16 has been collected, but it may optionally be any desired voice. That is, the voice of the "target speaker" need not be one of the actual plurality of speakers. At Block 2C the CTTS engine 18 optionally converts the data recorded from supplemental (non-target) speaker(s) so as to sound like the voice of the target speaker. This process can include pitch and/or temporal modification, or any suitable type of modification of the digitized speech samples. This particular operation may be considered as being optional, as the voice of a particular supplemental speaker may naturally sound sufficiently like the voice of the target speaker so as not to require modification. At Block 2D the CTTS engine 18 combines or pools data from one or more supplemental speakers with the target speaker's data, and builds and operates the CTTS 10 using the combined data in the database 17. This last operation may optionally include the use of a term in a cost function for selecting speech segments that prefers data from the original speaker and/or some of the supplemental speakers based on the quality of the transformed data. An end result is the provision of the substantially speaker-independent CTTS system 10 in accordance with embodiments of this invention In one non-limiting example of the use of the CTTS 10 two female speakers were found to be very close in pitch and spectral characteristics, and their respective speech segment databases 16 were combined or pooled without normalization. A third female speaker with markedly low pitch was processed using commercially available third party software, such as one known as Adobe® Audition™ 1.5, to raise the average pitch so as to be in the same range of pitch frequencies as the other two female speakers. The third female speaker's processed data were merged or pooled with the data of the other two speakers.

In accordance with non-limiting embodiments of this invention, during the process of building the pooled dataset stored in the database 17 by the CTTS engine 18 (indicated by the signal line or bus 18B shown in FIG. 1), each speech segment in the database 17 is labeled by an attribute vector that conveys information about that segment. In accordance with the embodiments of this invention one element of the attribute vector is the identity of the speaker who originally spoke that segment.

During synthesis the input speech segment data, which is preferably, but not as a limitation, in the form of an extended Speech Synthesis Markup Language (SSML) document (Burnett, N., Walker, M. and Hunt, A., "Speech Synthesis Markup Language (SSML) Version 1.0", Sep. 9, 2004, pages 1-48), are processed by an XML parser. The extended SSML tags are used to form a target attribute vector, analogous to one used in a voice-dataset-building process to label the speech segments. In this case one element of the target attribute vector is the identity of the target speaker (Speaker_ID, as in FIG. 1). Another element of the target attribute vector may be the expressive style (Style, as in FIG. 1) of the speech segment, such as "conveying good news," "conveying bad news," "asking a question," or "neutral", as was considered in Eide E. et al., "A Corpus-based Approach to <Ahem/> Expressive Speech Synthesis", Proceedings of the 5th ISCA Speech Synthesis Workshop, Pittsburgh, Pa., USA, Jun. 14-16, 2004, and in Hamza, W. et al., "The IBM Expressive Speech Synthesis System", Proceedings ICSLP, 2004, Jeju Island, Korea.

It can thus be appreciated than an aspect of this invention is a data structure that is stored in a computer readable medium for use in a concatenative text-to-speech system, where the data structure is comprised of a plurality of speech segments derived from a plurality of speakers, where each speech segment includes an associated attribute vector each of which is comprised of at least one attribute vector element that identifies the speaker from which the speech segment was derived. An additional element may be one that indicates a style of the speech segment. A speech segment may be derived from a speaker by simply sampling, digitizing and partitioning spoken words into some units, such as phonemes or syllables, with little or no processing or modification of the speech segments. Alternatively, a speech segment may be derived from a speaker by sampling, digitizing, spectrally or otherwise processing the digitized speech samples, such as by performing pitch enhancement or some other spectral modification, and/or by performing temporal modification, and partitioning the processed speech sample data into the units of interest.

An attribute cost function C(t,o) may be used to penalize the use of a speech segment labeled with an attribute vector o when the target is labeled by attribute vector t. A cost matrix $C_i$ is preferably defined for each element i in the attribute vector. An example of such a cost matrix is shown in FIG. 3 for the Speaker_ID element of the target attribute vector. The cost matrix specifies, for example, that the cost is 0.5 when using a speech segment from Speaker 2 when Speaker 3 is the target speaker.

Asymmetries in the cost matrix may arise because of different sizes of datasets. For example, if one speaker has a very large dataset compared to another speaker, it may be preferred to penalize more heavily the use of speech segments from the smaller dataset when the speaker with the large dataset is the target, and to penalize less heavily the use of segments from the large dataset when the speaker corresponding to the small dataset is the target.

A desired end result of the foregoing processes is that an audible speech word that is output from the loudspeaker 22 may be comprised of constituent voice sounds, such as phonemes or syllables, that are actually derived from two or more speakers and that are selectively concatenated together based on at least one cost function.

The embodiments of this invention may be implemented by computer software executable by the data processor 18A of the CTTS engine 18, or by hardware, or by a combination of software and hardware. Further in this regard it should be noted that the various blocks of the logic flow diagram of FIG. 2 may represent program steps, or interconnected logic circuits, blocks and functions, or a combination of program steps and logic circuits, blocks and functions.

The foregoing description has provided by way of exemplary and non-limiting examples a full and informative description of the best method and apparatus presently contemplated by the inventors for carrying out the invention. However, various modifications and adaptations may become apparent to those skilled in the relevant arts in view of the foregoing description, when read in conjunction with the accompanying drawings and the appended claims. For example, the use of other similar or equivalent speech processing and modification hardware and software may be attempted by those skilled in the art. Further, other types of cost functions and modifications of same may occur to those skilled in the art, when guided by these teachings. Still further, it can be appreciated that many CTTS systems will not include the microphone 12 and speech sampling sub-system 14, as once the database 16 is generated it can be provided in or on a computer-readable tangible medium, such as on a disk or in semiconductor memory, and need not be generated or even maintained locally. However, all such and similar modifications of the teachings of this invention will still fall within the scope of the embodiments of this invention.

Furthermore, some of the features of the preferred embodiments of this invention may be used to advantage without the corresponding use of other features. As such, the foregoing description should be considered as merely illustrative of the principles, teachings and embodiments of this invention, and not in limitation thereof.

What is claimed is:

1. A method comprising:

receiving a text word; and in response to receiving the text word, concatenating, by a data processor coupled to a memory, pre-recorded speech segments that are derived from a plurality of speakers to form audio data configured to generate an audible speech word that corresponds to the text word, wherein concatenating the pre-recorded speech segments comprises selecting speech segments for concatenation based on at least one cost function, where the at least one cost function comprises a first cost function where a cost of a speech segment from a particular speaker of the plurality of speakers is based at least in part on a size of a dataset comprising pre-recorded speech segments from the particular speaker as compared to sizes of other datasets each comprising pre-recorded speech segments from other speakers in the plurality of speakers, where the first cost function assigns a first cost for a first speech segment from a first speaker of the plurality of speakers that is lower than a second cost for a second speech segment from a second speaker of the plurality of speakers, where a first size of pre-recorded speech segments in a first dataset from the first speaker is greater than a second size of pre-recorded speech segments in a second dataset from the second speaker.

2. The method as in claim 1, where each pre-recorded speech segment comprises an attribute vector, and each attribute vector comprises a vector element that identifies the speaker from which the speech segment was derived.

3. The method as in claim 2, where each attribute vector further comprises another vector element that identifies a style of speech from which the speech segment was derived.

4. The method of claim 2, where the attribute vector of a pre-recorded speech segment comprises a cost matrix which specifies a cost of using the pre-recorded speech segment for each potential target speaker.

5. The method as in claim 1, where the pre-recorded speech segments are pre-recorded by a process that comprises designating one speaker as a target speaker, examining an input speech segment to determine if it is similar to a corresponding speech segment of the target speaker and, if it is not, modifying at least one characteristic of the input speech segment to make it more similar to the corresponding speech segment of the target speaker.

6. The method as in claim 5, where modifying comprises altering at least one of a temporal or a spectral characteristic of the input speech segment.

7. The method as in claim 1, where a speech segment comprises at least one of a phoneme, a syllable, and a word.

8. The method as in claim 1, where at least some of the pre-recorded speech segments are derived from a speaker by sampling, digitizing and partitioning spoken words into word units.

9. The method of claim 1, where the audible speech word is an audible speech word that sounds as though spoken by a target speaker.

10. An apparatus comprising:

a memory configured to store pre-recorded speech segments that are derived from a plurality of speakers; and a data processor configured to, in response to receiving a text word, concatenate the pre-recorded speech segments to form audio data configured to generate an audible speech word that corresponds to the text word, wherein concatenating the pre-recorded speech segments comprises selecting speech segments for concatenation based on at least one cost function, where the at least one cost function comprises a first cost function where a cost of a speech segment from a particular speaker of the plurality of speakers is based at least in part on a size of a dataset comprising pre-recorded speech segments from the particular speaker as compared to sizes of other datasets each comprising pre-recorded speech segments from other speakers in the plurality of speakers, where the first cost function assigns a first cost for a first speech segment from a first speaker of the plurality of speakers that is lower than a second cost for a second speech segment from a second speaker of the plurality of speakers, where a first size of pre-recorded speech segments in a first dataset from the first speaker is greater than a second size of pre-recorded speech segments in a second dataset from the second speaker.

11. The apparatus of claim 10, where each pre-recorded speech segment comprises an attribute vector, and each attribute vector comprises a vector element that identifies the speaker from which the pre-recorded speech segment was derived.

12. The apparatus of claim 11, where the attribute vector of a pre-recorded speech segment comprises a cost matrix which specifies a cost of using the pre-recorded speech segment for each potential target speaker.

13. The apparatus of claim 11, where each attribute vector further comprises another vector element that identifies a style of speech from which the pre-recorded speech segment was derived.

14. A computer readable medium tangibly embodying a program of instructions executable by a machine to perform operations, the operations comprising:

in response to receiving a text word, concatenating pre-recorded speech segments that are derived from a plurality of speakers to form audio data configured to generate an audible speech word that corresponds to the text word, wherein concatenating the pre-recorded speech segments comprises selecting speech segments for concatenation based on at least one cost function, where the at least one cost function comprises a first cost function where a cost of a speech segment from a particular speaker of the plurality of speakers is based at least in part on a size of a dataset comprising pre-recorded speech segments from the particular speaker as compared to sizes of other datasets each comprising pre-recorded speech segments from other speakers in the plurality of speakers, where the first cost function assigns a first cost for a first speech segment from a first speaker of the plurality of speakers that is lower than a second cost for a second speech segment from a second speaker of the plurality of speakers, where a first size of pre-recorded speech segments in a first dataset from the first speaker is greater than a second size of pre-recorded speech segments in a second dataset from the second speaker.

15. The computer readable medium of claim 14, where each pre-recorded speech segment comprises an attribute vector, and each attribute vector comprises a vector element that identifies the speaker from which the pre-recorded speech segment was derived.

16. The computer readable medium of claim 15 where the attribute vector of a pre-recorded speech segment comprises a cost matrix which specifies a cost of using the pre-recorded speech segment for each potential target speaker.

17. The computer readable medium of claim 15, where each attribute vector further comprises another vector element that identifies a style of speech from which the pre-recorded speech segment was derived.

* * * * *